US005636795A

United States Patent [19]

Sedgwick

[11] Patent Number: 5,636,795

[45] Date of Patent: Jun. 10, 1997

[54] CYCLONIC SPRAY NOZZLE

[75] Inventor: John K. Sedgwick, Stoney Creek, Canada

[73] Assignee: First Pioneer Industries Inc., Burlington, Canada

[21] Appl. No.: 439,519

[22] Filed: May 11, 1995

[51] Int. Cl.[6] ..... B05B 7/10

[52] U.S. Cl. ..... 239/406

[58] Field of Search ..... 239/548, 562, 239/588, 396, 403, 405, 406, 417.3, 424, 468, 208, 209, 751; 118/316; 134/123, 199; 29/DIG. 39

[56] References Cited

U.S. PATENT DOCUMENTS

| | | | |
|---|---|---|---|
| 2,351,697 | 6/1944 | Nielsen | 239/8 |
| 2,790,679 | 4/1957 | Martindale | 239/209 |
| 3,356,102 | 12/1967 | Johnson | 239/209 |
| 4,171,097 | 10/1979 | Rebold | 239/417.3 |
| 4,546,923 | 10/1985 | Ii | 239/406 |
| 4,801,261 | 1/1989 | Hagar | 239/406 |
| 5,273,059 | 12/1993 | Gross | 134/123 |
| 5,417,070 | 5/1995 | Richardson | 239/406 |

*Primary Examiner*—Robert J. Oberleitner
*Assistant Examiner*—C. T. Bartz
*Attorney, Agent, or Firm*—Patrick J. Hofbauer

[57] ABSTRACT

A cyclonic spray nozzle having a substantially cylindrical inlet chamber with a closed top end, an open bottom end and a tangential air inlet arranged adjacent to the closed top end. A truncated Cone-shaped discharge chamber having an open top end and an open bottom end of smaller diameter than the open top end, is secured to said open bottom end of said inlet chamber in axial, fluid communicating register therewith. A fluid injector nozzle is positioned within the discharge chamber in operative spraying relation to said open end of said discharge chamber. The nozzle is useful in spraying an axially directed mist of fluid over a relatively long distance, while containing radial overspray.

18 Claims, 6 Drawing Sheets

CYCLONIC SPRAY NOZZLE

FIELD OF THE INVENTION

The present invention relates to spray nozzles for the directed spraying of liquids onto surfaces, such as may be used in the detection of surface flaws in automotive parts production facilities.

BACKGROUND OF THE INVENTION

The trend to ever-increasing vehicle quality and tighter quality control in automotive vehicle and vehicle parts production continues unabated. Quality standards set but a decade ago have long since been abandoned as inadequate. Current standards are set not only with regard to the overall design of vehicles, but also to workmanship considerations such as fit and finish.

Flaws in paint finish, such as pits, dimples or discolouration may arise from underlying flaws in the metal surface of the vehicle part or assembly, or from excess moisture left on the subject part or assembly after it undergoes one or more liquid baths prior to application of the final finishing coats of paint. The now common use of so-called "clear-coat" finishes (incorporating a clear, pigment-less top coat of lacquer applied after other finish layers) only serves to exacerbate the problem by exaggerating any underlying flaws.

In order to increase efficiency on automotive parts production lines, it has, in recent years, become increasingly common to attempt to detect the surface flaws in parts or assemblies to be painted before they are actually painted. Substantial increases in efficiency can be realized if parts or assemblies-are identified as defective in their surface finish (but profitably salvageable), prior to final painting, so that such parts can be diverted for remedial surface preparation and then re-introduced into the production line. If surface flaws on the parts and/or assemblies are not detected until after final painting, then in order to effect salvage, the newly applied paint must be completely removed before carrying out remedial surface preparation to correct flaws. This paint removal step requires the expenditure of additional time and resources, thus potentially rendering salvage of the parts and/or assemblies unprofitable.

A process generally known as "highlighting" is now commonly used to detect surface flaws just prior to the entry of the part/assembly into the paint booth for final finishing. Highlighting involves the application of a water-based photoreflective liquid to the surface of the workpiece to be painted, and thereafter the viewing of the workpiece, at a preferred angle, in light of a preferred wavelength. This process has the effect of enhancing or "highlighting" any flaws in the surface of the workpiece prior to its being painted. Parts and/or assemblies having surface defects can then be diverted for remedial refinishing. Parts and/or assemblies which show no defects while passing through the highlighting unit continue on along the production line toward the paint booth for final finishing. The water-based highlighting chemical is typically washed off or otherwise removed by other processes from the part/assembly prior to application of the final finish(es) in the paint booth.

The use of a highlighting operation interposed between the final chemical bath and the paint booth dramatically reduces the number of finished parts/assemblies which are ultimately rejected due to surface finishing flaws. The benefits to be derived in using a highlighting process to detect surface irregularities, as described above, have been generally recognized and accepted by the automotive industry.

Nevertheless, certain shortcomings and problems in the highlighting process exist. For example, the highlighting chemical is typically applied by cloth or conventional brushes dragged across the surface of the part/assembly to be viewed. This application technique may result in brush patterns or lint particles being left on the workpiece, both of which interfere with the viewing of the workpiece under directed light of a selected wavelength. Accordingly, there is a potential for the introduction of further workpiece rejections as an artifact of the highlighting process. In theory, one could use conventional finishing spray equipment (as used in the application of the final paint coatings) to apply highlighting liquid, thus ensuring an excellent, even distribution of highlighting liquid. This technique is not, however, an acceptable application means for several reasons. Firstly, finishing spray equipment is quite costly, typically requiring robotics to evenly reach all surfaces of all but the simplest parts/assemblies. Secondly, such equipment requires relatively large amounts of floor space in assembly plants, which additional space is not generally available, or is too costly to provide, for allocation to a nonessential, salvaging function. Thirdly, such conventional spraying equipment for liquid coatings typically requires, for environmental and worker safety reasons, a spray booth to contain the relatively large amounts of "overspray" that they produce. The use of additional spray booths also introduces unacceptably high levels of cost and space allocation. For these reasons, conventional spray painting equipment has not found any significant degree of acceptance as a means for applying highlighting liquids to automotive parts/assemblies.

It is, therefore, an object of the present invention to provide a novel form of liquid spray nozzle which overcomes these and other problems associated with present means available for applying highlighting chemicals to, for example, automotive parts or assemblies.

More specifically it is an object of the present invention to provide a form of spray nozzle which provides for the application of a liquid to a surface in a fine aerosol form without leaving streaks or other patterns in the liquid so applied.

It is a further object of the present invention to provide a form of spray nozzle which provides for the application of a liquid to a surface in a fine aerosol form without leaving lint in the liquid so applied.

It is a further object of the present invention to provide a form of spray nozzle which provides for the directed application of a liquid to a surface to be coated in a fine aerosol spray with a minimum amount of overspray.

It is yet a further object of the present invention to provide a form of spray nozzle which provides for the directed application of a liquid to a surface to be coated in a fine aerosol spray with a minimum amount of overspray in a cost effective manner when compared to conventional spray painting equipment.

It is a further object of the present invention to provide a liquid spray nozzle which can be incorporated with other similar nozzles into a spray application system to provide for the substantially complete and uniform coverage of an object, having a large and complex surface shape, with a minimum amount of overspray and without the need for robotics.

It is a further object of the present invention to provide such a spray application system which requires a relatively small amount of floor space when compared to conventional spray painting equipment.

SUMMARY OF THE INVENTION

In accordance with the present invention there is disclosed a cyclonic spray nozzle comprising a substantially cylindrical inlet chamber having a substantially closed top end, an open bottom end and a tangential air inlet arranged adjacent said closed top end. A truncated cone-shaped discharge chamber having an open top end and an open bottom end of smaller diameter than said open top end is provided is secured by its top end to said open bottom end of said inlet chamber in axial, fluid communicating register therewith. A fluid injector nozzle is positioned within the discharge chamber in operative spraying relation to the open end of the discharge chamber.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF A PREFERRED EMBODIMENT

Figure 3:
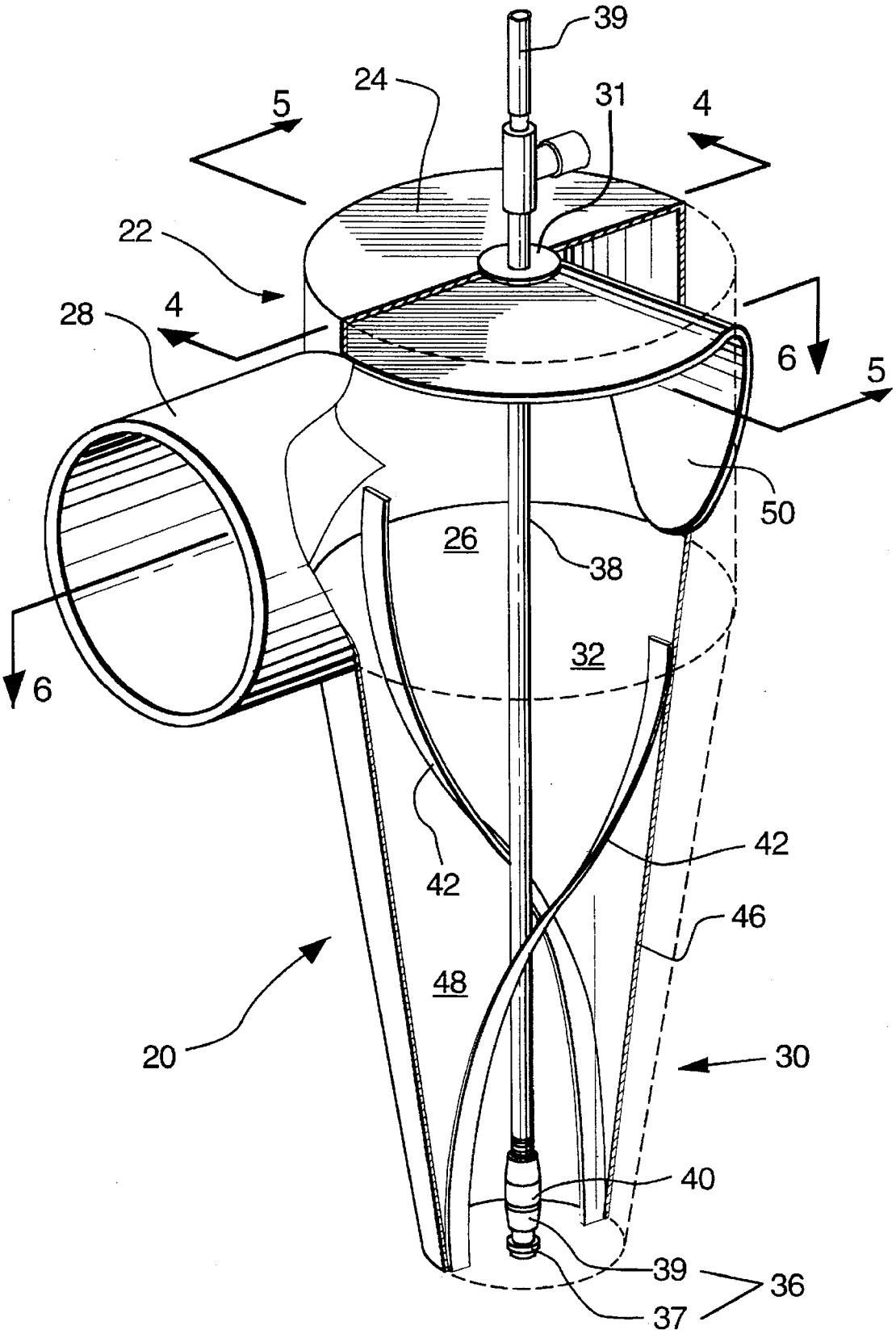
FIG. 3 of the drawings is a perspective view, partially cut away, of one of the cyclonic spray nozzles of FIG. 1.
Figure 4:
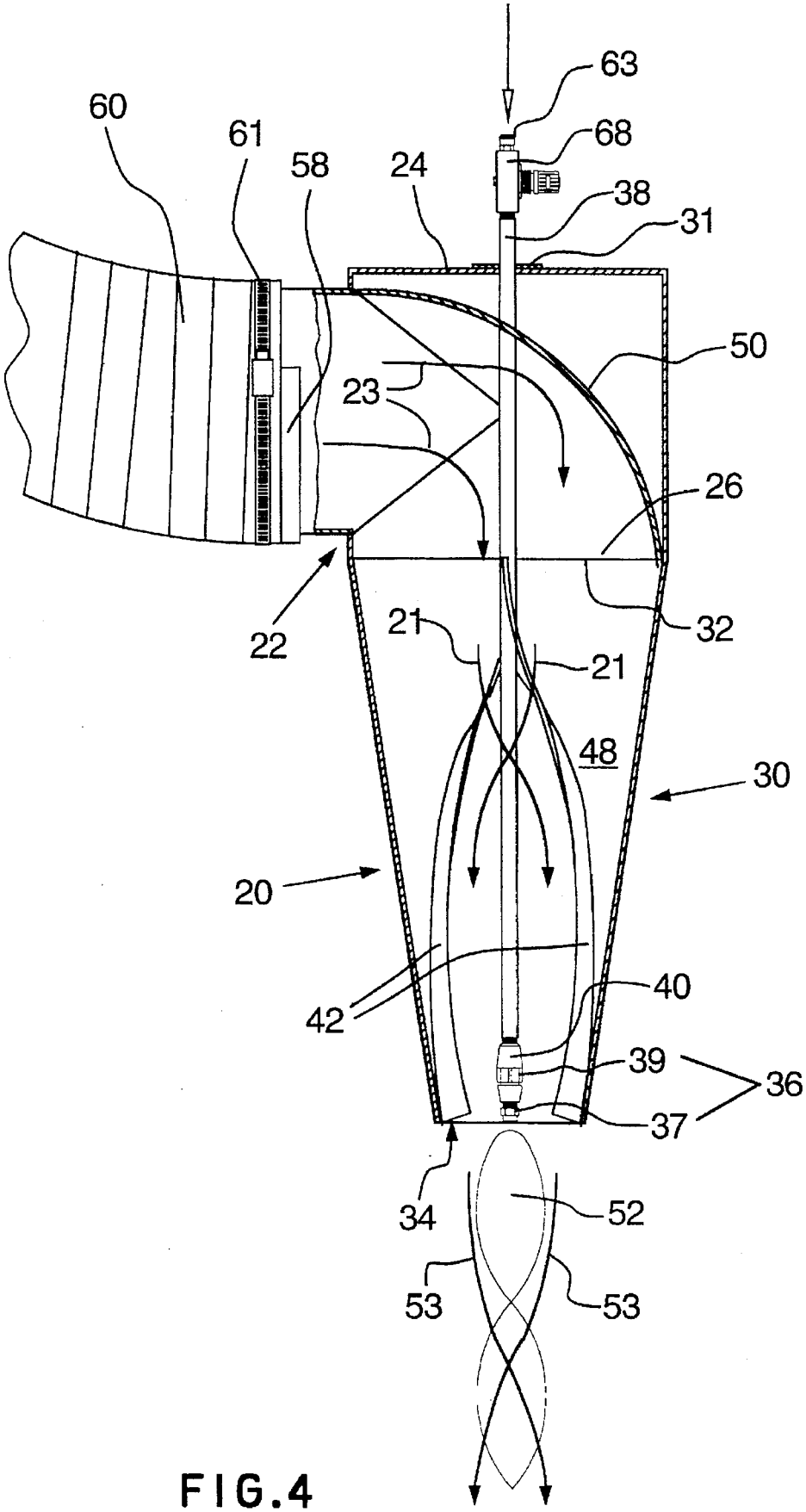
FIG. 4 of the drawings is a sectional view along sight line 4—4 of FIG. 3.
Figure 5:
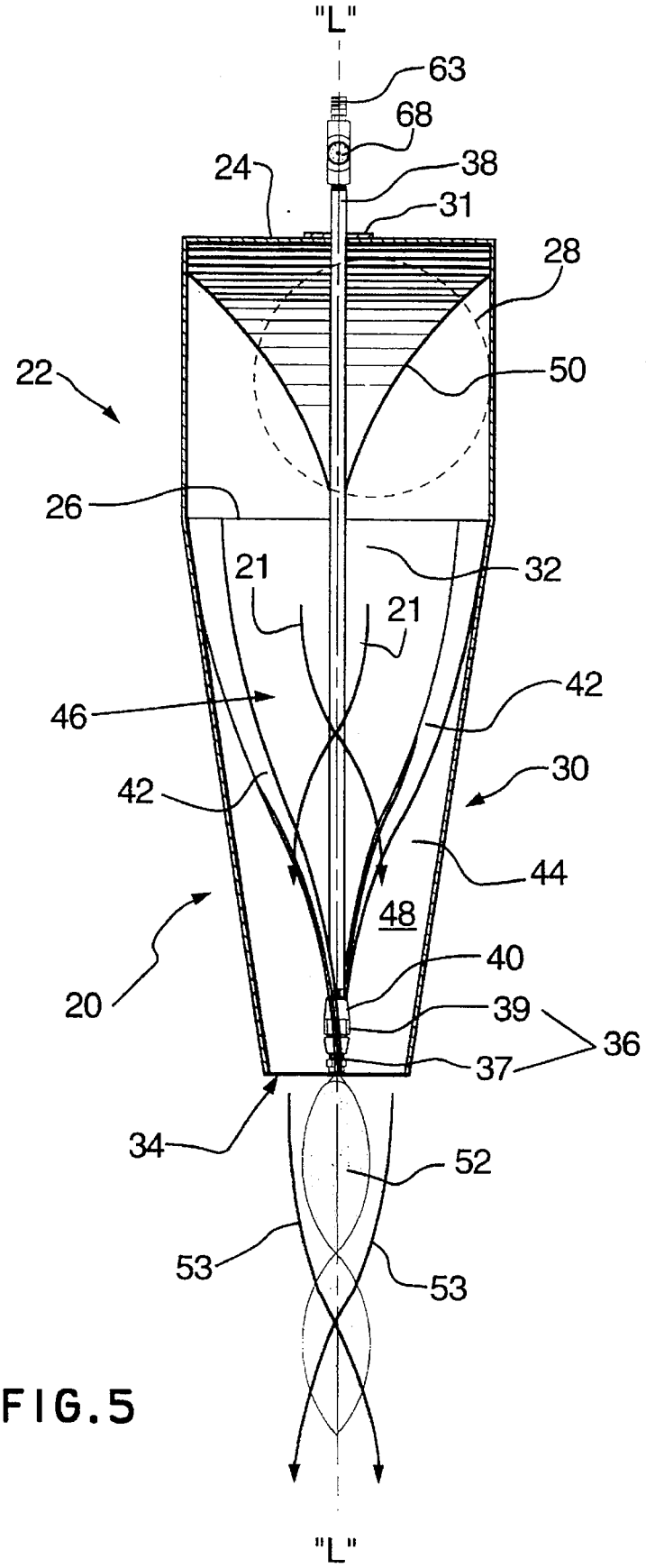
FIG. 5 of the drawings is a sectional view along sight line 5—5 of FIG. 3.

Referring now to FIGS. 3 through 6, of the drawings, a cyclonic spray nozzle according to a preferred embodiment of the invention is indicated by the general reference numeral 20. The orientation of the nozzle in FIGS. 3 through 5 is consistent with the orientation and reference directions as described and claimed subsequently herein.

Figure 6:
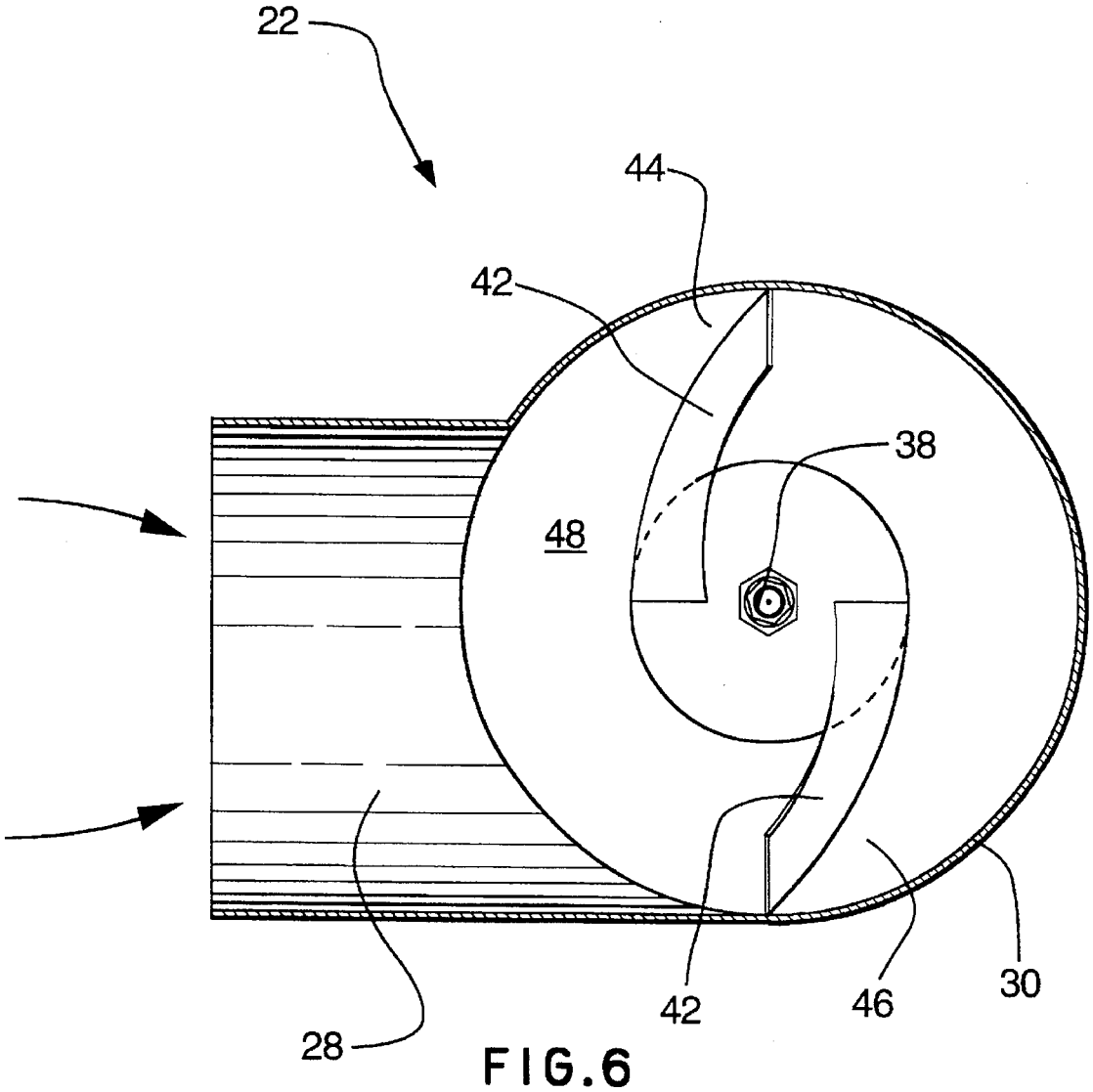
FIG. 6 of the drawings is a sectional view along site line 6—6 of FIG. 3.

The cyclonic spray nozzle 20 has a substantially cylindrical inlet chamber indicated by the general reference numeral 22. The inlet chamber 22 has a substantially closed top end 24, an open bottom end 26, and a tangential air inlet 28 which is tangential to one side of the circumference of the cylindrical inlet chamber 22. The tangential air inlet 28 is arranged, as shown, adjacent the closed top end 24 of inlet chamber 22. The tangential nature of the air inlet 28 and its arrangement adjacent closed top end 24 is best seen in FIGS. 3, 5 and 6 and is responsible for inducing a cyclonic air flow within the nozzle 20, as will become more apparent as this description proceeds.

A truncated cone-shaped discharge chamber 30 has an open top end 32 and an open bottom end 34, the open bottom end 34 being of smaller diameter than the open top end 32. The open top end 32 is secured to the open bottom end 26 of the inlet chamber 22 in axial, fluid communicating register therewith, by for example, arc welding, or other conventional fastening means. A fluid injector nozzle 36, comprised of a female-threaded nozzle tip 37 and a male-threaded nozzle body 39, is positioned within the discharge chamber 30 in operative spraying relation to the open end 34 of discharge chamber 30. Preferably, the fluid injector nozzle 36 should be positioned at or near (referred to in the claims hereof, as "adjacent to") the bottom open end 34 of discharge chamber 30 in axially aligned spraying relation through the bottom open end 34. A hollow fluid supply line 38 extends in aligned relation to longitudinal axis "L—L" (see FIG. 5) through a grommet 31 centrally positioned on the top wall 24 of the inlet chamber 22, and then axially through the discharge chamber 30, for operative connection to the nozzle body 39 of the fluid injector nozzle 36. A pressure check valve 40 is preferably operatively interconnected into the fluid supply line 38 between the top wall 24 of the inlet chamber 22 and the nozzle body 39 to provide for instant shut off of the fluid injector nozzle 36 thereby to minimize dripping of the sprayed fluid from the injector nozzle 36, which dripping may result in uneven surface application of the liquid on the workpiece (not shown).

One or more spiral-shaped directing vane means 42 are positioned in generally axially extending relation within the discharge chamber 30. In the preferred embodiment of the present invention shown, two directing vane means 42 are utilized, and are positioned one each in welded relation on radially opposed wall portions 44 and 46 of an inner surface 48 of the discharge chamber 30. The two directing vane means 42 are spirally curved 20 to assist in radially rotating the cyclonic air stream (as identified by flow arrows 21 in FIGS. 4 and 5) as the air passes through the discharge chamber 30. In the preferred embodiment illustrated, the vanes are positioned and curved to rotate the air flow through approximately 90° of rotation along the extent of axis L—L of the discharge chamber 30. However, other degrees of rotation, for example, 180° of rotation have utility, depending upon the precise application for the nozzle and the target angular velocity required for such applications. The two spirally shaped directing vane means 42 are also preferably 180° out of phase meaning their respective starting and finishing points are on diametrically opposed points or the inner surface 48 of the discharge chamber 30. Again, however, this can be routinely varied by one skilled in the art to change the cyclonic air flow characteristics and parameters within the discharge chamber 30 in a predictable manner.

The inlet chamber 22 is dimensioned so as to have a smaller volume than the discharge chamber 30. As a result of this volume differential, a drop in air pressure occurs as the air passes from the inlet chamber 22 into the discharge chamber 30. A volume drop of about 15% is preferable, although this percentage is highly variable. This pressure drop assists in formation of a central zone of low pressure in the vicinity of the top open end 32 of the discharge chamber 30, which is useful in creation and continued formation of the vortex of a cyclonic air stream within said discharge chamber 30. A curved baffle means 50 is optionally provided in fixed relation in the inlet chamber 22, adjacent the closed top end 24, so as to re-direct the flow of incoming air which enters the inlet chamber 22 into a generally axial direction from the generally tangential direction from which it first enters.

In use, a high speed, high volume flow of air is introduced into the inlet chamber 22 of the cyclonic spray nozzle 20 from a flexible air duct 60 attached by a conventional hose clamp 61 to the tangential air inlet 28. The air flow encounters the baffle means 50 and is deflected thereby toward the open bottom end 20 of the inlet chamber 27. The flow of air passes from the open bottom open end 26 of the inlet chamber 22 through the top open end 32 of the discharge chamber 30 toward the directing vane means 42, positioned one each on the inner surface 48 of the discharge chamber 30. The introduction of a tangential air flow, coupled with the aforementioned pressure drop induces the ongoing creation of an axially downwardly directed cyclonic air stream. The directing vane means 42 aid in sustaining this cyclonic effect and impart specific design rotational characteristics thereto. The cyclonic air stream comprises a relatively high pressure peripheral outer zone and a centrally disposed low pressure zone, comprising at the "eye" or vortex of the cyclonic air stream thus created. This cyclonic air flow is maintained to a significant extent even after the air stream leaves the bottom open end 34 of the discharge chamber 30, as indicated by the air flow lines 53 of FIGS. 4 and 5. A preferred ratio of the axial length of the inlet chamber 22 to the axial length of the discharge chamber 30 is about 1:2, although this ratio may vary substantially as required by the specific application.

A fine mist of the fluid 52 to be applied by the cyclonic spray nozzle 20 is introduced into the centre of the air flow stream through the fluid injector nozzle 36, the positioning of which preferably coincides with the centrally disposed low pressure zone at the vortex of the cyclonic air stream. The mist of fluid 52 is in this manner substantially contained within the central low pressure zone by the peripheral wall of the relatively more dense cyclonic air stream represented by the flow arrows 53, and is to some extent axially carried further than would otherwise be the case by the low pressure zone being dragged along by the artificially created "cyclone". In this manner, the liquid being sprayed is substantially contained in a defined known volume, such that very little uncontrolled "overspray" results. Thus, through careful, but readily determinable, selection of the dimensions of and volumes of the inlet chamber 22, the discharge chamber 30, the lengths and the angling of the vane means 42, the spray pattern of the liquid 53 can be closely controlled for specific applications. Moreover, the density of the liquid spray coating on the workpiece to be coated, (not shown in FIGS. 3–6) can also be controlled by means of a conventional fluid control valve 68 threadingly attached into the liquid supply line 38.

Figure 1:
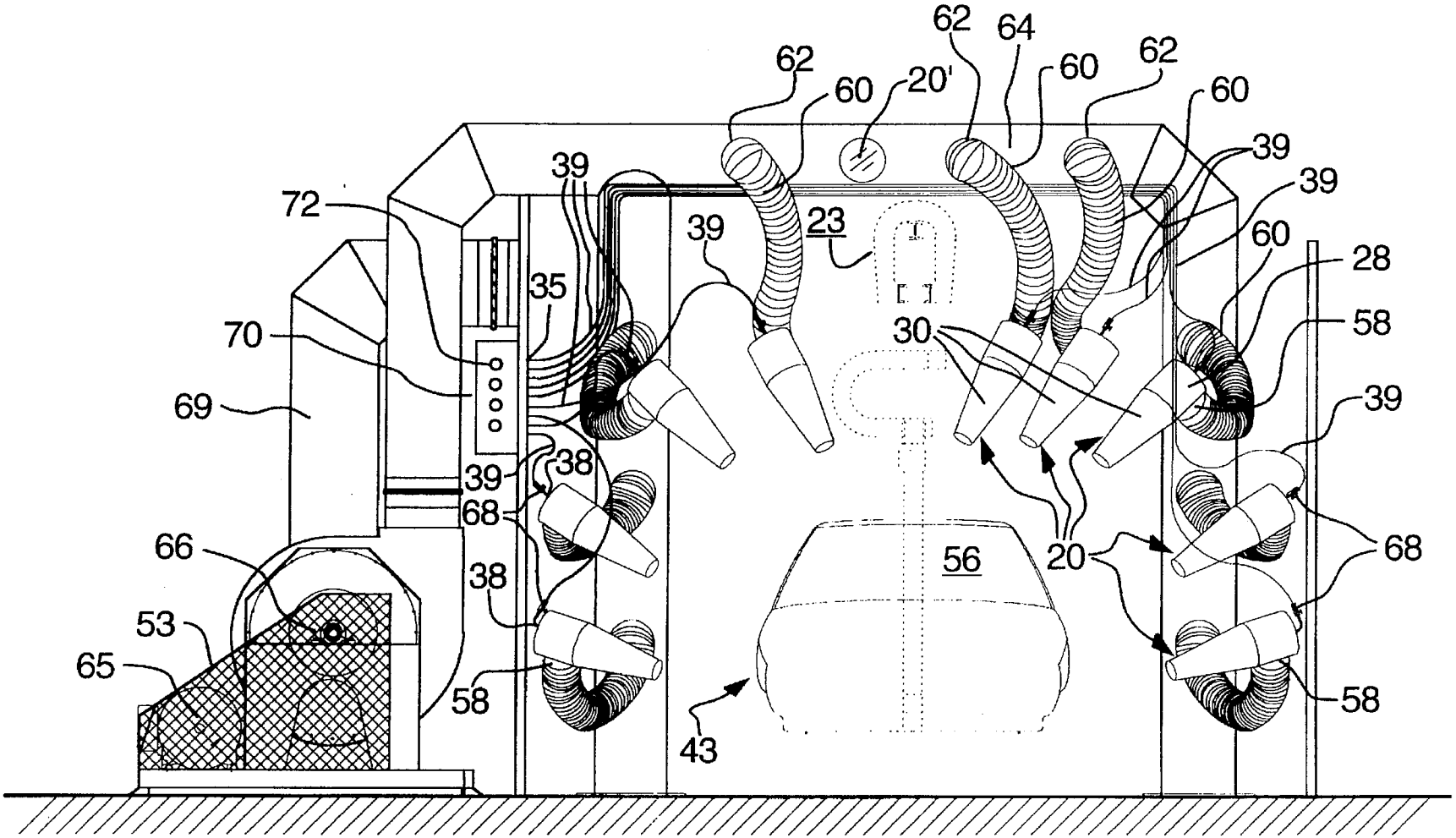
FIG. 1 of the drawings appended hereto is a diagrammatic front elevational view of a plurality of cyclonic spray nozzles according to a preferred embodiment of the invention collectively arranged for the spraying of a vehicle body assembly on a vehicle production line.
Figure 2:
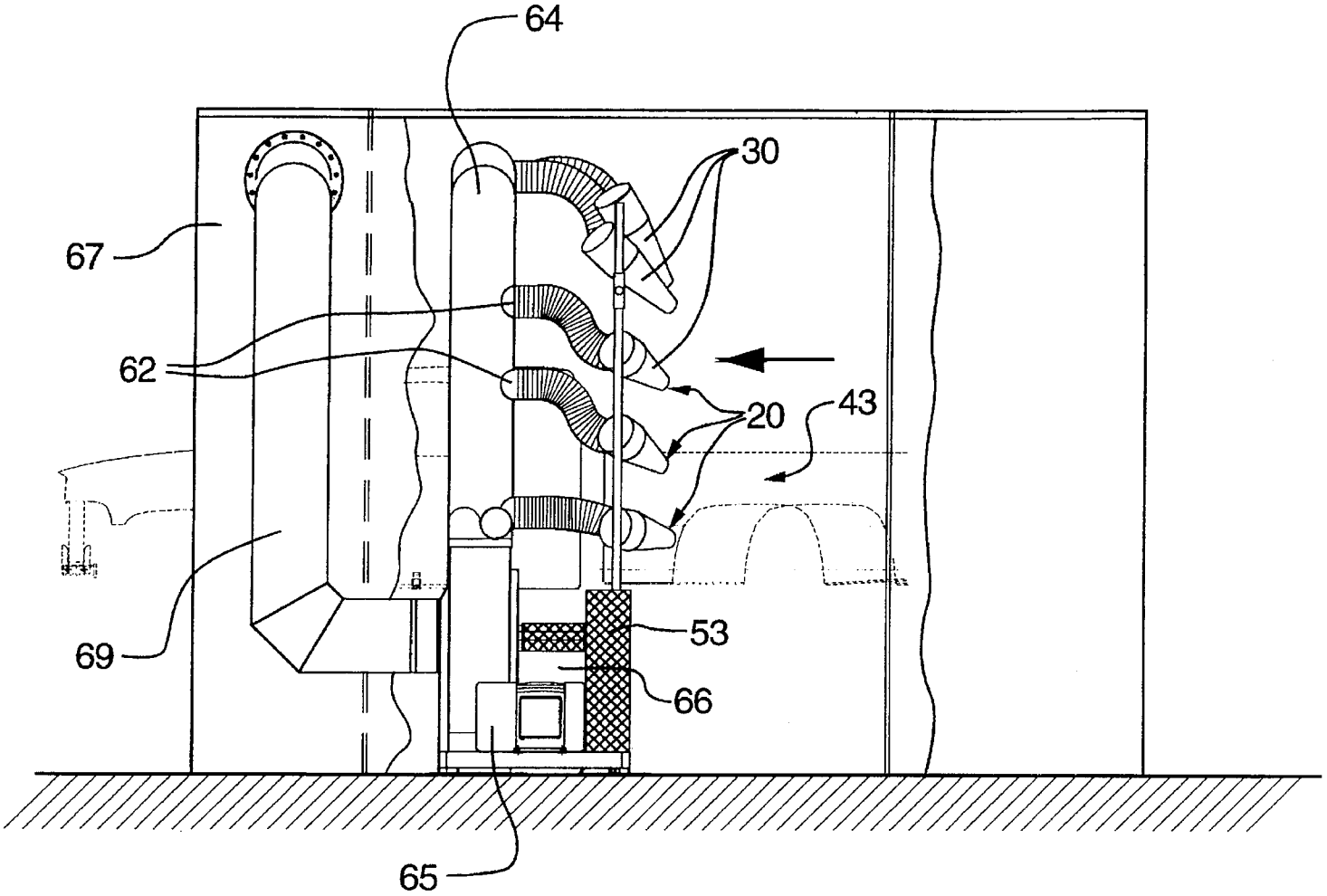
FIG. 2 of the drawings is a diagrammatic side elevational view of the arrangement of FIG. 1.

Cyclonic spray nozzles 20 according to the invention can be used singly for spraying relatively small and generally planar workpieces. A plurality of such cyclonic spray nozzles can be coordinated into advantageous combinations for the spraying of large and/or complex shaped objects. In FIGS. 1 and 2, a system for spraying vehicle body assemblies is illustrated, in which a plurality of cyclonic spray nozzles according to the preferred embodiment described above are positioned and directed to generate a "wall" of liquid spray through which spray complex workpieces, in the form of vehicle body assemblies 43, may serially pass. The vehicle bodies 43 are suspended from a conventional overhead conveyer system 23, shown only in phantom outline in FIG. 1. (The top-central nozzle assembly has been omitted at 20' in FIG. 1 for ease of illustration.) The plurality of cyclonic spray nozzles 20 are arranged, generally, in an arc-like formation, and are adjustably directed to generate a liquid spray flow toward a central zone 56 displaced between the arms of the arc-like formation. Each of the cyclonic spray nozzles 20 is connected at its respective tangential air inlet 28 to one end 58 of a respective one of a corresponding plurality of flexibly adjustable air ducts 60. The air ducts 60 are preferably constructed from steel reinforced neoprene rubber material, though other flexible ducting materials may be used. The opposite other ends 62 of each of the respective air ducts 60 are connected to an air supply plenum 64. The air supply plenum 64 is operatively connected to and is fed by a high capacity centrifugal fan means 66. The fan means 66 preferably generates a minimum flow rate of 6,000 feet per minute, at 10 inches of static pressure, but the physical characteristics of the fan means 66 can be routinely determined for specific applications depending upon the number of cyclonic nozzles 20, their size etc. A drive belt (not shown) operatively connects the fan means 66 to an electric motor 65, and is protectively covered by a safety cage 53. The electric motor 65 must be of sufficient power to drive the fan means 66 at such flow rates for lengthy periods of time without reaching an overload condition. Filtered air is supplied to the fan means 66 by a conventional air filter means 67 (see FIG. 2) through an air duct 69. The fluid supply line 38 of each nozzle 20 is connected by the threaded end 63 of its fluid control valve 68 to a flexible supply line 39. Each of the flexible supply lines 39 is operatively connected at its opposite other end 35 to a distribution header 54, which distribution header 54 is itself in operative fluid communication with a bulk liquid supply tank (not shown) filled with the highlighting liquid to be sprayed. Each of the fluid control valves 68 can be used to independently control the liquid spray volume of a respective one of the cyclonic spray nozzles 20 to achieve, in combination with adjustable movement of the nozzles 20, a thorough overall spray pattern in the zone 56. An operator control box 70, having control buttons 72, is used to simultaneously operate the motor 65, the fan means 66, and the spray fluid supply from header 54 in order to effectively coordinate operation of the liquid spray system with the conveyor system 23. The nozzles 20 are readily re-adjustable to suit different sizes and shapes of assemblies passing thereunder, being supported not only by the flexible adjustable air ducts 60, but also by a conventional support frame (not shown).

In the preferred embodiment described and illustrated above, the cyclonic spray nozzles 20 of the present invention are used to apply highlighting liquid for the detection of surface flaws prior to the final painting of vehicle parts/assemblies. It would be obvious to those skilled in the art that the invention could be used effectively in a wide range of other spraying applications. For example, the invention could be used for painting and finishing of objects of all types wherein a high quality, though not necessarily perfect, finish is satisfactory (ie. automotive parts other than parts of the body visible in the finished product). Similarly, the invention could also be used, for example, to apply preservatives to wooden workpieces, such as boarding and panelling. Thus, it will be apparent that the scope of the present invention is limited only by the claims set out hereinbelow.

I claim:

1. A cyclonic spray nozzle for non-fuel related applications comprising:

a substantially cylindrical inlet chamber having a substantially closed top end, an open bottom end and a tangential air inlet arranged adjacent said closed top end;

a truncated cone-shaped discharge chamber having an open top end and an open bottom end discharging to ambient atmosphere, said open bottom end being of smaller diameter than said open top end, said open top end being secured to said open bottom end of said inlet chamber in axial, fluid communicating register therewith; and, a fluid injector nozzle of substantially smaller diameter than the diameter of said open bottom end of the discharge chamber positioned within said discharge chamber adjacent to said open bottom end of the discharge chamber in non-contacting relation thereto and adjacent to said bottom open end of the discharge chamber in axially aligned operative spraying relation to said open bottom end of said discharge chamber.

2. A cyclonic spray nozzle according to claim 1, wherein a fluid supply line axially extends through said top wall of the inlet chamber and through said discharge chamber for operative connection to said fluid injector nozzle.

3. A cyclonic spray nozzle according to claim 2, wherein a pressure check valve is operatively interconnected into said fluid supply line between said top wall and said fluid injector nozzle.

4. A cyclonic spray nozzle according to claim 3, wherein at least one spiral-shaped directing vane means positioned in axially extending relation within the discharge chamber in non-contacting relation with said fluid injector nozzle for radially rotating an air flow passing axially through said discharge chamber from said open top end to said open bottom end.

5. A cyclonic spray nozzle according to claim 4, having two of said spiral-shaped directing vane means provided, one each, on radially opposed wall portions of said discharge chamber.

6. A cyclonic spray nozzle according to claim 5, wherein said two spiral-shaped directing vane means radially rotate said air flow through substantially 180 degrees of rotation while passing axially through said discharge chamber from said open top end to said open bottom end.

7. A cyclonic spray nozzle according to claim 5, wherein said two spiral-shaped directing vane means radially rotate said air flow through substantially 90 degrees of rotation while passing axially through said discharge chamber from said open top end to said open bottom end.

8. A cyclonic spray nozzle according to claim 6, wherein said two spiral-shaped directing vane means are 90 degrees out of phase one with the other.

9. A cyclonic spray nozzle according to claim 7, wherein said two spiral-shaped directing vane means are 90 degrees out of phase one with the other.

10. A cyclonic spray nozzle according to claims 4, wherein a baffle means for axially deflecting an incoming air flow entering said air inlet is provided in said inlet chamber adjacent said closed top end.

11. A cyclonic spray nozzle according to claim 10, wherein the inlet chamber is dimensioned so as to have a smaller volume than said discharge chamber, thereby to cause a pressure drop in said air flow as it passes from said inlet chamber to said discharge chamber.

12. A cyclonic spray nozzle according to claim 11, wherein the ratio of the axial length of the inlet chamber to the axial length of the discharge chamber is substantially 1:2.

13. A plurality of cyclonic spray nozzles according to claim 12, said plurality being collectively arranged in an arc-like formation with the open ends of the discharge portions of each of said nozzles being directed toward a central zone displaced between the arms of said arc.

14. A plurality of cyclonic spray nozzles according to claim 13, wherein each of said cyclonic spray nozzles is connected at its respective tangential air inlet to one end of a flexibly adjustable air duct constructed from steel reinforced neoprene rubber material.

15. A plurality of cyclonic spray nozzles according to claim 14, wherein the opposite other end of said adjustable air duct is connected to an air supply plenum.

16. A plurality of cyclonic spray nozzles according to claim 15, wherein said air supply plenum is connected to a high capacity fan means.

17. A plurality of cyclonic spray nozzles according to claim 16, wherein the corresponding plurality of fluid supply lines are operatively connected at their opposite other ends to a pressure header, which pressure header is itself in operative fluid communication with a bulk liquid supply tank filled with a liquid to be sprayed through said liquid injector nozzles.

18. A plurality of cyclonic spray nozzles according to claim 17, wherein a fluid flow control valve is operatively interposed in each of the respective ones of said fluid supply lines between said respective pressure check valve and said pressure header.

* * * * *